United States Patent [19]

Renger et al.

[11] Patent Number: 4,580,991

[45] Date of Patent: Apr. 8, 1986

[54] ANIMATED FIGURE TOY HAVING TELESCOPING EYES

[75] Inventors: Larry H. Renger, Hawaiian Gardens; Roger H. Sweet, Long Beach, both of Calif.

[73] Assignee: Mattel, Inc., Hawthorne, Calif.

[21] Appl. No.: 682,216

[22] Filed: Dec. 17, 1984

[51] Int. Cl.[4] ..... A63H 3/38

[52] U.S. Cl. ..... 446/320; 446/341; 446/379; 446/392

[58] Field of Search ..... 446/337, 339, 340, 341, 446/343, 348, 349, 391, 392, 320, 330, 376, 378, 379, 380

[56] References Cited

U.S. PATENT DOCUMENTS

| | | | |
|---|---|---|---|
| 1,683,561 | 8/1928 | Letson . | |
| 1,760,318 | 5/1930 | Poore | 446/341 |
| 2,334,290 | 11/1948 | Richter | 46/119 |
| 2,668,394 | 2/1954 | Auzin | 46/135 |
| 2,701,934 | 2/1955 | Auzin | 46/135 |
| 2,741,870 | 4/1956 | Lang | 46/119 |
| 3,099,894 | 8/1963 | Carrol | 46/135 |
| 3,236,006 | 2/1966 | Carroll | 446/341 |
| 3,451,160 | 6/1969 | Ryan | 46/135 |
| 3,986,295 | 9/1976 | Keller | 46/119 |
| 4,279,419 | 7/1981 | Barnes et al. | 446/376 |

FOREIGN PATENT DOCUMENTS

| | | | |
|---|---|---|---|
| 1024875 | 4/1966 | United Kingdom | 446/341 |
| 2068243 | 8/1981 | United Kingdom | 446/341 |

*Primary Examiner*—F. Barry Shay

*Attorney, Agent, or Firm*—Ronald M. Goldman; Melvin A. Klein

[57] ABSTRACT

An animated figure toy (10) includes an upper torso (14) provided with a head (18) in which a pair of elongated members (34) are reciprocably mounted for movement by an operating member (26) affixed to the lower ends of the elongated members and riding in a slot (42) provided in the back of the upper torso. A lower torso (16) is rotatably mounted on the upper torso and includes a spring means (54) mounted on a boss (46) coupling the torsos together for limited relative rotation.

2 Claims, 5 Drawing Figures

ANIMATED FIGURE TOY HAVING TELESCOPING EYES

TECHNICAL FIELD

The present invention relates to animated figure toys and more particularly to a new and useful animated figure toy having telescoping eyes.

BACKGROUND ART

U.S. Pat. No. 1,683,561, discloses a figure toy having a head mounted to the upper end of a rotatable and longitudinally-movable shaft. The shaft enters a neck opening in the top of the toy and extends to a position adjacent the botton of the toy. The shaft is attached to a push button in a manner such that the push button may be used to elevate and rotate the shaft.

U.S. Pat. No. 2,334,290,, discloses an animated figure toy in which the head may be actuated at a point remote from the head to simulate both knodding and shaking of the head.

U.S. Pat. No. 2,668,394 discloses a rubber air-filled toy figure which has expansible ears, eyes and other parts adapted to snap out of the body portion when the toy is squeezed, and to snap back into the body portion when the squeezing pressure is released.

U.S. Pat. No. 2,701,934, also discloses a rubber air-filled toy figure which has expansible ears, eyes and other parts adapted to snap out of the body portion when the toy is squeezed, and to snap back into the body portion when the squeezing pressure is released.

U.S. Pat. No. 2,741,870, discloses a growing figure toy having a body which may be elongated by stroking a push button connected to a rack and pinion mechanism.

U.S. Pat. No. 3,009,894 discloses a stuffed animated toy animal in which the eyes, ears, tongue, nose and tail may be mechanically moved, as be levers and strips mounted on the animal's back and extending through its body.

U.S. Pat. No. 3,451,160, assigned to the assignee of the instant invention, discloses an animated figure toy with a body made from a hollow compressible member, and with conduits leading from the body into the head of the toy with outlets adjacent the toy's eyes, and attached to rotatable discs. The discs are caused to rotate when the toy's body is compressed.

U.S. Pat. No. 3,986,295, assigned to the assignee of the instant application, discloses a figure toy having an arm rotatably mounted to a torso; a hand carried on a shaft, which shaft is received within the hollow of the arm; means located within the hollow of the arm for latching the shaft in a first position and biasing means located within the hollow of the arm for urging the shaft forward out of the hollow arm; and means responsive to manual actuation of a torso portion for unlatching the shaft to cause the hand to extend to a position remote from the end of said arm. A gauntlet of a sleeve-like nature surrounds the arm and is coupled at an end to the hand so as to obstruct visibility of the shaft when the hand is in the extended position to thereby simulate an increase in length of the arm.

DISCLOSURE OF INVENTION

In accordance with the present invention, a new and useful animated figure toy is provided with telescoping eyes. The figure toy includes an upper torso and a lower torso with means rotatably connecting the lower torso to the upper torso. Also, means are provided in one of the upper and lower torsos to extend and retract the telescoping eyes of the figure toy.

BRIEF DESCRIPTION OF THE DRAWINGS

Details of the present invention will be described in connection with the accompanying drawings wherein.

BEST MODE FOR CARRYING OUT THE INVENTION

Figure 1:
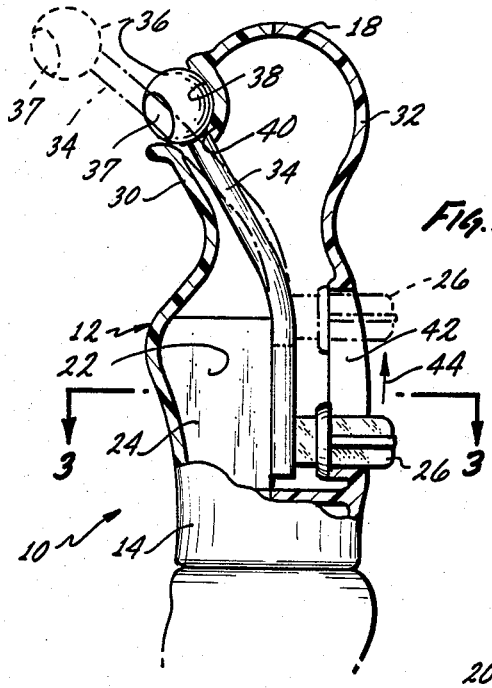
FIG. 1 is a partial side elevational view, partially in cross-section, of an animated figure toy constituting a presently-preferred embodiment of the invention.

Referring to the drawings, a figure toy constituting a presently-preferred embodiment of the invention, generally designated 10, includes a hollow body 12 comprising an upper torso 14 and a lower torso 16, only a portion of which is shown, which may be rotated with respect to each other.

Figure toy 10 also includes a head 18, and, if desired may be provided with one or more other appendages, such as arms, legs, antennas, etc. fixed to the torsos and/or held thereto in any convenient manner. The head 18 is hollow, and is preferably formed integrally with the upper torso 14, in a casting or molding operation.

As stated above, upper torso 14 and head 18 are preferably hollow, and may be made from one or more halves held together in any convenient manner, such as by pin-and-socket-type connectors 20. A hollow interior 22 connects the inner portions of the head and upper torso. One or more vertical walls 24 in which an operating member 26 is captured are formed in upper torso 14. A further pair of vertical walls 28 are also provided between the walls 24, and are also fixed to one half of the upper torso.

Figure 3:
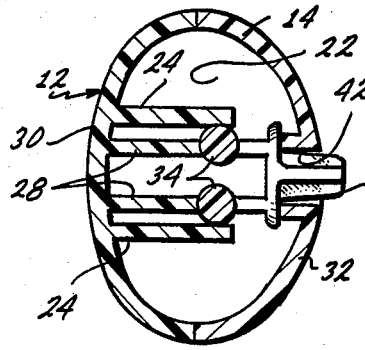
FIG. 3 is a cross-sectional view taken along line 3—3 of FIG. 1.
Figure 4:
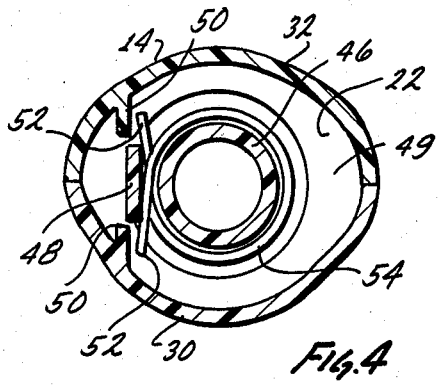
FIG. 4 is an enlarged cross-sectional view taken in line 4—4 of FIG. 2.
Figure 5:
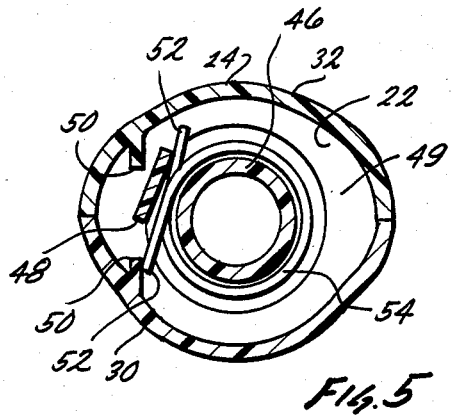
FIG. 5 is a view similar to FIG. 4, but with the upper and lower torsos rotated with respect to each other, with a return spring means also turned, and in position to bias the torsos to their rest positions.

As shown in FIGS. 1 and 3, upper torso 14 and head 18 include a front half 30 and a rear half 32. The front half 30 preferably includes, the spaced-apart guiding or vertical walls 24, 28. These walls form guides for elongated appendages or eye stalks 34 fixed to the operating member 26 and riding in a way formed by small clearances between the vertical walls 24, 28. Walls 24, 28 form a track of stalks 34, the stalks being held in the track by the structure of member 26 coacting with the end faces of the walls of slot 42.

Figure 2:
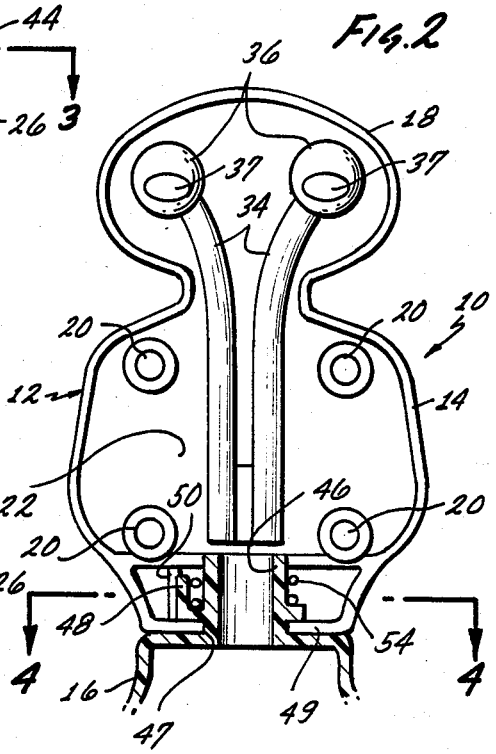
FIG. 2 is a partial front elevational view, in cross-section, similar to FIG. 1.

Large bulbous eyes 36, having large irises 37 are coupled to the exterior or outer ends of the eye stalks 34, distant from the operating member 26. These eyes, in the lowered or rest position, are captured or rest in concave or hollowed out eye socket portions 38 formed in the front half of head 18. Openings 40 are formed extending from the hollow interior 22 of the torso head 18 to allow the stalks 34 to pass through. Thus, elongated stalk portions 34 are telescopically mounted in toy 10 for movement between the lower or rest position shown in solid line in FIGS. 1 and 2, and the elevated or extended position shown in broken line in FIG. 1. This movement is accomplished by moving or sliding operating member 26 riding in a slot 42 provided in the back or rear torso half 32. The operating member 26 is moved in the direction of arrow 44, from the lowered position, shown in solid line, to the raised position shown in broken line in FIG. 1, to thereby raise or extend the stalks 34 and therefore, the eyes 36 outwardly from their resting position in eye sockets 38.

Lower torso 16 is rotatably connected to upper torso 14 by means of a cylindrical boss 46 formed integrally with the lower torso and extending upwardly, through an opening 47 formed therein, into upper torso 14. The lower torso 16, the boss 46, and an extending wall portion 48 fixed to or formed integrally with the boss 46 may be integrally molded from a suitable polymeric material. A stop means 50, such as walls, are fixed or formed integrally in the front and rear halves of upper torso 14 and coact with ends 52 of a torsion spring 54 mounted over boss 46 of lower torso 16. The stop means 50, engage the ends 52 to prevent the turning of the lower torso 14, in either direction, more than a predetermined amount, and to bias or return the torsos to their starting or rest positions.

While the particular animated figure toy herein shown and described in detail is fully capable of attaining the objects and providing the advantages hereinbefore stated, it is to be understood that it is merely illustrative of the presently-preferred embodiment of the invention. No limitations are intended in the details of construction or design herein shown other than as defined in the appended claims.

The term "means", as employed in the claims is to be interpreted as defining the corresponding structure illustrated and described in the specification or the equivalent thereof.

We claim:

1. A figure toy comprising:

a hollow upper torso having a hollow head integrally formed with said upper torso, said upper torso being provided with a back slot opening formed therein, said head including concave eye sockets formed therein with apertures passing through a wall portion of said eye sockets and connecting with the hollow interior of said upper torso;

a plurality of vertical wall members extending from an inside surface of said hollow upper torso, said wall members defining a track;

a pair of elongated members movably mounted in said hollow upper torso and extending into said head, each of said elongated members including a substantially vertically orientated portion slidably engaging said track and a slanted portion extending above and from said vertically orientated portion and through one of said apertures, each slanted portion having an upper end extending through one of said apertures in said eye sockets in said head and having an eye fixed thereto and normally seated in one of said eye sockets;

operating means attached to said elongated members and guided in said back slot opening in said upper torso for moving said elongated members from a first position with said eyes disposed in said eye sockets to a second position with said eyes extended from said head; and means for coupling said lower torso to said upper torso and coacting therewith, said coupling means including a pair of stop members formed in said upper torso separated by a predetermined distance so that when said torsos are rotated with respect to each other, from a starting position, the relative rotation of said torsos will be limited, and said torsos will be returned to said starting position after release of the force causing said rotation.

2. The figure toy recited in claim 1 wherein said coupling means further includes a boss extending from said lower torso and rotatably mounted within said upper torso, said boss having an integral portion riding on the upper surface portion of a horizontal base formed in said upper torso, and said coupling means further includes:

a torsion spring having two ends mounted on and surrounding said boss; and said stop members formed in said upper torso and coacting with the ends of said torsion spring on said boss to limit rotation of said torsos, and to return said torsos to said starting position after release of said force.

* * * * *